United States Patent [19]

Hürlemann et al.

[11] Patent Number: 4,798,124

[45] Date of Patent: Jan. 17, 1989

[54] GAS REMOVAL APPARATUS FOR AN AUTOMATIC FIRING WEAPON CONTROLLED BY THE GAS PRESSURE

[75] Inventors: Ernst Hürlemann, Zurich; Hans Häfeli, Döttingen, both of Switzerland

[73] Assignee: Werkzeugmaschinenfabrik Oerlikon-Bührle AG, Zürich, Switzerland

[21] Appl. No.: 26,304

[22] Filed: Mar. 16, 1987

[30] Foreign Application Priority Data

Mar. 20, 1986 [CH] Switzerland ..... 01 121/86-9

[51] Int. Cl.[4] ..... F41D 5/04

[52] U.S. Cl. ..... 89/193

[58] Field of Search ..... 89/191.01, 193

[56] References Cited

U.S. PATENT DOCUMENTS

| | | | |
|---|---|---|---|
| 2,058,897 | 10/1936 | Marek | 89/193 |
| 2,388,396 | 11/1945 | Eklund | 89/193 |
| 2,872,851 | 2/1959 | Katz | 89/193 |
| 3,333,509 | 8/1967 | Mühlemann et al. | 89/193 |
| 4,611,525 | 9/1986 | Bosshard et al. | 89/193 |

FOREIGN PATENT DOCUMENTS

| | | | |
|---|---|---|---|
| 514237 | 10/1952 | Belgium | 89/193 |
| 672139 | 3/1966 | Belgium . | |
| 0158705 | 10/1985 | European Pat. Off. . | |
| 167067 | 1/1986 | European Pat. Off. | 89/193 |
| 1154624 | 4/1958 | France . | |
| 172150 | 7/1960 | Sweden | 89/193 |

*Primary Examiner*—Stephen C. Bentley

*Attorney, Agent, or Firm*—Werner W. Kleeman

[57] ABSTRACT

A gas removal apparatus for an automatic firing weapon controlled by gas pressure contains a gas removal channel structure extending from a gas removal location to a gas receiving location and exhibiting one or two gas deflection locations as well as a gas throughflow element, such as a gas nozzle or gas throttle. Both the gas deflection locations and the gas nozzle or gas throttle are in danger of being eroded by the throughflowing gas. Therefore, these elements are constructed such that the gas erosion is as small as possible. According to the invention, this is attained by guiding a gas removal channel section or portion of the gas removal channel structure through a shrunk-fitted ring which is shrunk fitted onto the weapon barrel to a gas rail, by inserting the gas nozzle or gas throttle in the shrunk-fitted ring between the shrunk-fitted ring and the gas rail and by positioning a gas deflection insert in the gas rail.

17 Claims, 1 Drawing Sheet

GAS REMOVAL APPARATUS FOR AN AUTOMATIC FIRING WEAPON CONTROLLED BY THE GAS PRESSURE

BACKGROUND OF THE INVENTION

The present invention relates to a new and improved construction of a gas removal apparatus for an automatic firing weapon controlled by gas pressure.

In its more specific aspects, the present invention relates to a new and improved construction of a gas removal apparatus for an automatic firing weapon controlled by gas pressure. The automatic firing weapon possesses a weapon barrel containing a gas removal location, and a breechblock sleeve or housing in which the weapon barrel is replaceably or detachably fixed or secured. A gas cylinder is provided in the breechblock sleeve or housing and in this gas cylinder there is arranged a piston which is shiftable or displaceable by the gas pressure. A gas receiving opening or channel is provided in the breechblock sleeve or housing and leads to the gas cylinder. The gas removal location is located at a distance or spacing before or upstream of the gas receiving opening or channel viewed in the direction of the lengthwise axis of the weapon barrel. An outwardly-open groove or groove means provided in the outer surface of the weapon barrel extends in the lengthwise or longitudinal direction of the weapon barrel between the gas removal location and the gas receiving opening or channel, and a gas rail is arranged in the outwardly-open groove or groove means. This gas rail is held at its ends in the outwardly-open groove or groove means and contains a gas removal channel portion or section in its interior which connects the gas receiving opening of the breechblock sleeve or housing with the gas removal location of the weapon barrel.

Gas removal apparatuses of this type are known from prior art constructions. For example, in German Pat. No. 1,453,934, published Jan. 15, 1970, the gas removal channel structure consists of three sections, of which the first section in the weapon barrel is arranged transversely to the weapon barrel axis, the second section in the gas rail is arranged parallel to the weapon barrel axis, and the third section in the breechblock sleeve or housing is again arranged transverse to the weapon barrel axis. Therefore, the gas flow is deflected twice, in each case through a right angle. It has now been found that with high gas pressures and corrosive gases, the erosion in the gas channel is great.

Additionally, there is known to the art a gas-jet nozzle pipe for a breechblock drive and for the munitions transport of an automatic firing weapon, for example from European Pat. No. 0,158,705, published Oct. 23, 1985. This gas-jet nozzle pipe is located within a cylindrical bore of a barrel ring positioned parallel to the weapon barrel axis and which contains an axial inner bore extending parallel to the weapon barrel. This axial inner bore is connected to a gas removal bore formed from the outside obliquely in the weapon barrel and extending into the interior of the weapon barrel. This known gas-jet pipe nozzle contains in the region of its cylindrical jacket a connecting conduit extending obliquely from the gas removal bore to the axial inner bore. The connecting conduit exhibits a larger diameter from the entrance or inlet opening to the intersecting surface formed by the axial inner bore than the diameter of the axial inner bore, whereby the intersecting surface also constitutes the location of deflection of the throughflowing gas jet flowing within the gas-jet nozzle pipe and the gas jet is deflectable by an angle of inclination $\alpha<90°$ corresponding to the inclination of the connecting conduit with respect to the axial inner bore.

This known apparatus does have the advantage that the erosion essentially takes place inside the gas-jet nozzle pipe, i.e. in an easily replaceable part. This gas erosion is, however, extraordinarily great, so that the nozzle pipe must be constantly replaced.

SUMMARY OF THE INVENTION

Therefore with the foregoing in mind, it is a primary object of the present invention to provide a new and improved construction of a gas removal apparatus for an automatic firing weapon controlled by gas pressure and which is not afflicted with the aforementioned drawbacks and shortcomings of the prior art constructions.

Another important object of the present invention aims at the provision of an improved gas removal apparatus possessing a gas removal channel structure which is so constructed at the locations of gas deflection that gas erosion damage is maintained as small as possible.

Still a further significant object of the present invention is to provide an improved construction of a gas removal apparatus for an automatic firing weapon wherein the transition or transition location from a predetermined region of the gas removal channel structure to the gas throughflow element, such as the gas nozzle or gas throttle, and the transition or transition location from the gas nozzle or gas throttle to a further predetermined region of the gas removal channel are constructed such that to the greatest extent possible no gas erosion damage can arise.

It is still a further noteworthy object of the present invention to provide a gas removal apparatus which is constructed such that, to the greatest possible extent, gas erosion damage only occurs at easily replaceable parts of the gas removal apparatus.

Yet an additional object of the present invention is to provide an improved construction of gas removal apparatus for an automatic firing weapon wherein individual parts of the gas removal apparatus are constructed such that good gas sealing is guaranteed at the transitions or transition locations of the gas removal channel structure from one section or region thereof to the next, in order to avoid disturbances or malfunctions caused by gas leakage.

Now in order to implement these and still further objects of the invention which will become more readily apparent as the description proceeds, the inventive gas removal apparatus is manifested by the features that the gas removal channel structure is guided to the gas rail from the gas removal location through a ring or ring member which is shrunk fitted onto the weapon barrel, that a gas throughflow element, such as a gas nozzle or gas throttle, is inserted into the shrunk-fitted ring between the shrunk-fitted ring and the gas rail, and that a gas deflecting member or piece is positioned in the gas rail between the gas receiving opening and the gas rail.

The construction of the gas removal apparatus according to the invention has, among other things, the following advantages:

(a) The gas removal apparatus is composed of several parts, in particular a shrunk-fitted ring or ring member, a gas throughflow element, such as a gas nozzle or gas throttle, a gas rail or rail member and a gas deflection or deflecting member or piece, each of which can be easily replaced if gas erosion damage occurs.

(b) The separation of the different functions, namely, gas removal, gas deflection, gas throttling and gas release or expansion by the use of cross-sectional changes fundamentally reduces erosion damages, whereby the service or working life of the gas removal apparatus is prolonged or modern corrosive gases can be used and with which higher pressures can be attained.

BRIEF DESCRIPTION OF THE DRAWINGS

The invention will be better understood and objects other than those set forth above will become apparent when consideration is given to the following detailed description thereof. Such description makes reference to the annexed drawings depicting an exemplary embodiment of a gas removal apparatus for an automatic firing weapon controlled by gas pressure and wherein.

DETAILED DESCRIPTION OF THE PREFERRED EMBODIMENTS

Figure 1:
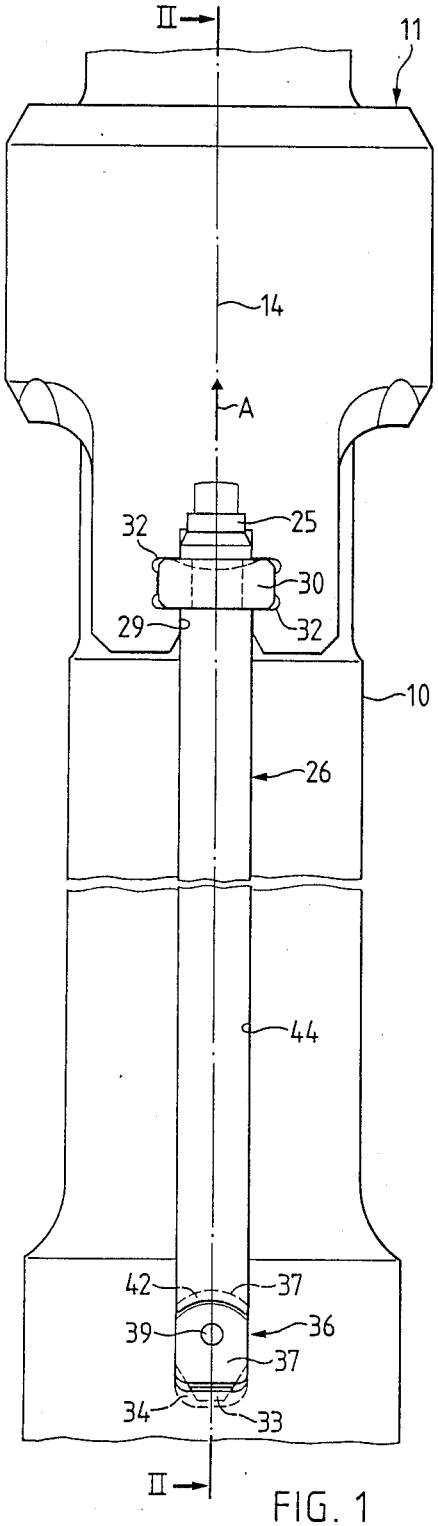
FIG. 1 is a view from above of a portion of a weapon barrel equipped with the inventive gas removal apparatus.
Figure 2:
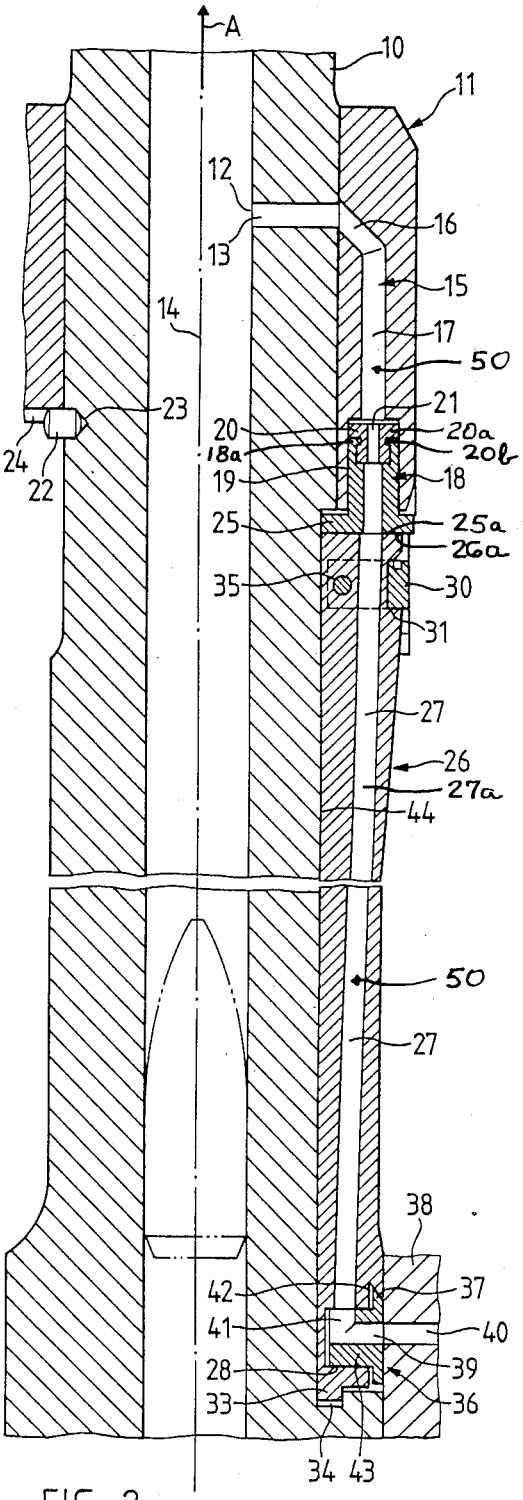
FIG. 2 is a sectional view of the arrangement of FIG. 1 taken substantially along the line II—II thereof.

Describing now the drawings, it is to be understood that to simplify the showing thereof only enough of the structure of the gas removal apparatus for an automatic firing weapon controlled by gas pressure has been illustrated therein as needed to enable one skilled in the art to readily understand the underlying principles and concepts of the present invention. Turning now specifically to FIGS. 1 and 2 of the drawings, a ring or ring member 11 is attached as by being shrunk fitted onto a weapon barrel 10. In the region of this shrunk-fitted ring or ring member 11, the weapon barrel 10 contains a gas removal location or opening 12 from which a first gas removal channel section or portion 13 of a gas removal channel structure, generally indicated in its entirety by reference character 50 in FIG. 2, leads to the shrunk-fitted ring or ring member 11. This gas removal channel section or portion 13 is formed by a bore 13 which is preferably arranged at essentially right angles or transversely with respect to the lengthwise or longitudinal axis 14 of the weapon barrel 10. However, this bore 13 can be slopingly positioned or inclined at a desired or random angle greater or less than 90° with respect to the weapon barrel lengthwise axis 14.

In consideration of the erosion to be expected in this transverse bore 13, such bore 13 is frequently positioned to be inclined at an angle of 75° with respect to the weapon barrel lengthwise axis 14. The shrunk-fitted ring or ring member 11 contains a second gas removal channel section or portion 15 which is formed of two bores 16 and 17. The first bore 16 is inclined with respect to the longitudinal direction of the weapon barrel 10 or the weapon barrel lengthwise axis 14 such that it is possible to bore or otherwise appropriately machine the bore 16 from the inside of the shrunk-fitted ring or ring member 11. The second bore 17 is positioned substantially parallel to the weapon barrel lengthwise axis 14. The second gas removal channel section or portion 15 opens out into a gas throughflow element, such as a gas throttle or gas nozzle 18, which is inserted into a third bore 19 of the shrunk-fitted ring or ring member 11 which is located in a position which is substantially coaxial to the second bore 17.

This gas nozzle or gas throttle 18 possesses an insert or insert member 20 formed of heat-resistant material. This insert or insert member 20 contains a very precise bore or passage 21 which influences the firing cadence of the firing weapon. By a precise bore or passage 21 there is meant a bore or passage whose diameter is exactly coordinated with or matched to the desired firing cadence of the firing weapon. It is therefore necessary to use a heat-resistant material for this insert or insert member 20. So that the insert or insert member 20 can not fall out of the gas nozzle or gas throttle 18, special measures for fixing the insert or insert member 20 in position in the gas nozzle or gas throttle 18 are necessary. Preferably, the insert or insert member 20 possesses a flange **20*a* provided thereat with a circumferential groove 20*b* in which an edge 18*a* of the gas nozzle or gas throttle 18** is flanged or fitted.

In order that the gas can reliably pass from the first gas removal channel section or portion 13 of the weapon barrel 10 to the second gas removal channel section or portion 15 of the shrunk-fitted ring or ring member 11, it is necessary to protect the shrunk-fitted ring or ring member 11 against an unintended rotation or shifting on the weapon barrel 10. For this purpose there is provided a pin 22 or equivalent structure projecting into a blindhole bore 23 of the weapon barrel 10 and into a recess 24 of the shrunk-fitted ring or ring member 11. The gas nozzle or gas throttle 18 possesses a quadrangular, such as a rectangular flange 25 which is eccentrically fastened to the gas nozzle or gas throttle 18. This flange 25 enables the gas nozzle or gas throttle 18 inserted into the shrink-fitted ring or ring member 11 to be again pulled out of the bore 19 of the shrink-fitted ring or ring member 11. This gas nozzle or gas throttle 18 is supported with its flange 25 on a gas rail or rail member 26. The supporting surface **25*a* of the flange 25 and the associated supporting surface 26*a* of the gas rail or rail member 26 are polished or ground so that no gas can escape between the flange 25, the gas nozzle or gas throttle 18 and the gas rail or rail member 26**.

The gas rail or rail member 26 contains a third gas removal channel section or portion 27 formed by a bore **27*a* which opens into a transverse bore 28. As shown in FIG. 1, the gas rail or rail member 26 projects into a recess 29 of the shrunk-fitted ring or ring member 11 and is secured against shifting in the recess 29 of the shrunk-fitted ring or ring member 11 by a bracket or clip 30 or equivalent structure. In FIG. 2, the bracket or clip 30 will be seen to project into a recess or groove 31 of the gas rail or rail member 26 and, in FIG. 1, the bracket or clip 30 will be seen to project into two recesses or grooves 32 of the shrunk-fitted ring or ring member 11**.

The gas pressure strives to push the gas nozzle or gas throttle 18 out of the bore 19 and to press it against the gas rail or rail member 26, whereby the bracket or clip 30 prevents the gas rail or rail member 26 from being shifted back opposite to the direction of arrow A in FIG. 1. Arrow A represents the firing direction of the firing weapon. The gas rail or rail member 26 contains a projection or shoulder 33 at its rear end which projects into a groove 34 of the weapon barrel 10. In this way, the gas rail or rail member 26 is anchored with its rear end in the weapon barrel 10. The front end of the gas rail or rail member 26 is anchored by a pin 35 or the like in the shrunk-fitted ring or ring member 11. The bracket or clip 30, which surrounds the gas rail or rail member 26 on three sides in a substantially U-shaped manner, is likewise secured against falling out by this pin 35.

A gas deflection insert or piece 36 is located in the transverse bore 28. This gas deflection insert or piece 36 is pressed by the gas pressure with its flange 37 against a weapon housing or casing 38 of the firing weapon. The gas deflection insert or piece 36 contains a bore 39 which is directed at right angles or transversely to the weapon barrel lengthwise axis 14 and is aligned with a gas receiving channel or location 40 in the housing or casing 38. This bore 39 of the deflection insert or piece 36 opens into a recess 41 which is aligned with the third gas receiving channel section or portion 27.

The flange 37 of the gas deflection insert or piece 36 projects into a bevelled groove 42 of the gas rail 26 and is thereby secured against falling out. The bore 39 is preferably positioned eccentrically in the deflection insert or piece 36, so that the erosion-endangered wall 43 is as thick as possible. The gas receiving channel 40 leads to a here not particularly shown gas cylinder in which there is located a piston which is driven by the gas removed from the weapon barrel, as such is well known in this technology. Exemplary of such an arrangement and structure is, for instance, that disclosed in the aforementioned German Pat. No. 1,453,934, published Jan. 15, 1970, to which reference may be readily had and the disclosure of which is incorporated herein by reference. In order to prevent an incorrect or false mounting or assembly of the gas deflection insert or piece 36, the flange 37 is preferably eccentrically constructed. As previously mentioned, in order to prevent the heat-resistant insert or insert member 20 from falling out of the gas nozzle or gas throttle 18, this heat-resistant insert or insert member 20 contains a groove or recess **20*b* in which an edge 18*a* of the gas nozzle or gas throttle 18** is fitted.

In order to guarantee the separation of the various functions mentioned in the introductory portion of this disclosure, the bore 13 arranged transverse to the weapon barrel lengthwise axis 14 is positioned between the gas removal location 12 and the bore 16 which is inclined with respect to the weapon barrel lengthwise axis 14, so that gas removal and gas deflection occur at two different places.

The bore 17 which is arranged substantially parallel to the weapon barrel 14 is positioned between the bore 16 inclined to the weapon barrel lengthwise axis 14 and the gas nozzle or gas throttle 18, so that gas deflection and gas throttling occur at two different places. Furthermore, the gas rail or rail member 26 with its gas removal channel section or portion 27 is arranged between the gas nozzle or gas throttle 18 and the gas deflection insert or piece 36, so that gas throttling and subsequent gas deflection occur at two different places.

In order to facilitate the removal of the gas nozzle or gas throttle 18 from the bore 19 of the shrunk-fitted ring or ring member 11, the flange 25 of the gas nozzle or gas throttle 18 is dimensioned such that it can be supported on the base of the outwardly-open groove 44 in the weapon barrel 10, whereby a tilting or canting of the gas nozzle or gas throttle 18 in the bore 19 is avoided.

While there are shown and described present preferred embodiments of the invention, it is to be distinctly understood that the invention is not limited thereto, but may be otherwise variously embodied and practiced within the scope of the following claims. Accordingly,

What I claim is:

1. A gas removal apparatus for an automatic firing weapon controlled by gas pressure, comprising:

a weapon barrel having an outer surface and a lengthwise axis;

said weapon barrel being provided with a gas removal location;

a weapon housing;

said weapon barrel being replaceably secured in said weapon housing;

a gas receiving channel provided in said weapon housing;

said gas removal location provided for said weapon barrel being positioned, as viewed in the direction of the lengthwise axis of the weapon barrel, at a distance upstream of said gas receiving channel in said weapon housing with respect to a predeterminate direction of gas flow between the gas removal location and the gas receiving channel;

an outwardly-open groove provided at said outer surface of said weapon barrel and extending in the longitudinal direction of said weapon barrel between said gas removal location and said gas receiving channel;

a gas rail having oppositely situated ends and arranged in said outwardly-open groove;

said gas rail being held at said oppositely situated ends in said outwardly-open groove;

a shrunk-fitted ring provided for said weapon barrel;

said gas rail and said shrunk-fitted ring conjointly defining a gas removal channel structure flow communicating said gas receiving channel in said weapon housing and said gas removal location in said weapon barrel;

a gas throughflow element inserted into said gas removal channel structure;

said gas throughflow element being located in said gas removal channel structure in a transition region between said shrunk-fitted ring and said gas rail; and a gas deflection insert postioned in said gas rail between said gas receiving channel and said gas rail.

2. The gas removal apparatus aas defined in claim 1, wherein:

said gas throughflow element comprises a gas nozzle.

3. The gas removal apparatus as defined in claim 1, wherein:

said gas throughflow element comprises a gas throttle.

4. The gas removal apparatus as defined in claim 1, further including:

a heat-resistant insert anchored at said gas throughflow element which is located in said transition region between said shrunk-fitted ring and said gas rail;

said gas throughflow element being provided with a bore;

said heat-resistance insert being provided with a bore which possesses a smaller diameter than the bore of said gas throughflow element; and said two bores being positioned substantially coaxially with respect to one another.

5. The gas removal apparatus as defined in claim 4, wherein:

said heat-resistant insert contains a flange and a groove; and said gas throughflow element which is located in said transition region between said shrunk-fitted ring and said gas rail, having an edge portion which is anchored in position in said groove of said heat-resistant insert.

6. The gas removal apparatus as defined in claim 1, wherein:

said gas removal channel structure contains a gas removal channel portion in said shrunk-fitted ring which contains two bores; and one bore of said two bores being inclined at a predeterminate angle with respect to the other one of said two bores and extending obliquely from said gas removal location in said weapon barrel.

7. The gas removal apparatus as defined in claim 6, wherein:

said one bore of said two bores being inclined at an angle of approximately 45° with respect to said other one of said two bores; and said one bore of said two bores extending in said shrunk-fitted ring at an obtuse angle smaller than 180° from said gas removal location in said weapon barrel.

8. The gas removal apparatus as defined in claim 1, wherein :

said gas deflection insert is slidingly guided in said gas rail and can be pressed by the gas pressure in gas-tight relationship against said weapon housing.

9. The gas removal apparatus as defined in claim 8, wherein:

said gas rail is provided with groove means;

said gas deflection insert contains a flange which projects into said groove means of said gas rail, in order to prevent said gas deflection insert from falling out of the gas rail when said weapon barrel is disaasembled from said housing.

10. The gas removal apparatus as defined in claim 9, wherein:

said flange of said gas deflection insert is asymetrically constructed such that there is precluded false assembly of the gas deflection insert.

11. The gas removal apparatus as defined in claim 1, wherein:

said gas removal channel structure conjointly defined by said shrunk-fitted ring and said gas rail comprises a bore extending transversely with respect to said lengthwise axis of said weapon barrel and a bore arranged at an oblique inclination with respect to said lengthwise axis of said weapon barrel and flow communicating with said transversely extending bore;

said gas removal channel structure further including a bore arranged substantially parallel to said lengthwise axis of said weapon barrel and positioned between said gas removal location and said gas throughflow element; and said gas removal channel structure comprising a gas removal channel portion arranged in said gas rail at a location between said gas throughflow element and said gas deflection insert which is arranged in spaced relation from said gas throughflow element.

12. A gas removal apparatus for an automatic firing weapon controlled by gas pressure, comprising:

a weapon barrel having an outer surface and a lengthwise axis;

said weapon barrel being provided with a gas removal location;

a weapon housing;

said weapon barrel being replaceably secured in said weapon housing;

a gas receiving channel provided in said weapon housing;

said gas removal location provided for said weapon barrel being positioned, as viewed in the direction of the lengthwise axis of the weapon barrel, at a distance upstream of said gas receiving channel in said weapon housing with respect to a predeterminate direction of gas flow between the gas removal location and the gas receiving channel;

an outwardly-open groove provided at said outer surface of said weapon barrel and extending in the longitudinal direction of said weapon barrel between said gas removal location and said gas receiving channel;

a gas rail having oppositely situated ends and arranged in said outwardly-open groove;

said gas rail being internally provided with a gas removal channel portion of a gas removal channel structure flow communicating the gas receiving channel of the weapon housing with the gas removal location of the weapon barrel;

a shrunk-fitted ring provided for said weapon barrel;

said gas removal channel structure being guided from said gas removal location to said gas rail through said shrunk-fitted ring;

a gas throughflow element inserted into said shrunk-fitted ring between said shrunk-fitted ring and said gas rail;

a gas deflection insert positioned in said gas rail between said gas receiving channel and said gas rail;

said gas removal channel structure containing a gas removal channel portion in said shrunk-fitted ring which contains two bores;

one bore of said two bores being inclined at a predeterminate angle with respect to the other one of said two bores;

a bracket having oppositely situated sides and serving for anchoring said gas rail at one of said oppositely situated ends of said gas rail to said shrunk-fitted ring;

said shrunk-fitted ring having groove means;

said gas rail having groove means;

said bracket projecting on one oppositely situated side thereof into said groove means of said gas rail and on the other oppositely side thereof into said groove means of said shrunk-fitted ring; and said gas throughflow element being slidingly mounted together with said heat-resistant insert in said shrunk-fitted ring and can be pressed by the gas pressure in gastight relationship against said gas rail.

13. A gas removal apparatus for an automatic firing weapon controlled by gas pressure, comprising:

a weapon barrel having an outer surface and a lengthwise axis;

said weapon barrel being provided with a gas removal location;

a weapon housing;

said weapon barrel being replaceably secured in said weapon housing;

a gas receiving channel provided in said weapon housing;

said gas removal location provided for said weapon barrel being positioned, as viewed in the direction of the lengthwise axis of the weapon barrel, at a distance upstream of said gas receiving channel in said weapon housing with respect to a predeterminate direction of gas flow between the gas removal location and the gas receiving channel;

an outwardly-open groove provided at said outer surface of said weapon barrel and extending in the longitudinal direction of said weapon barrel between said gas removal location and said gas receiving channel;

a gas rail having oppositely situated ends and arranged in said outwardly-open groove;

said gas rail being held at said oppositely situated ends in said outwardly-open groove;

said gas rail being internally provided with a gas removal channel portion of a gas removal channel structure flow communicating the gas receiving channel of the weapon housing with the gas removal location of the weapon barrel;

a shrunk-fitted ring provided for said weapon barrel;

said gas removal channel structure being guided from said gas removal location to said gas rail through said shrunk-fitted ring;

a gas throughflow element inserted into said shrunk-fitted ring between said shrunk-fitted ring and said gas rail;

a gas deflection insert positioned in said gas rail between said gas receiving channel and said gas rail;

a heat-resistant insert anchored at said gas throughflow element;

said gas throughflow element being provided with a bore;

said heat-resistant insert being provided with a bore which possesses a smaller diameter than the bore of said gas throughflow element;

said two bores being positioned substantially coaxially with respect to one another;

said heat-resistant insert containing a flange and a groove;

said gas throughflow element having an edge portion which is anchored in position in said groove of said heat-resistant insert;

said shrunk-fitted ring having bore; and said gas throughflow element contains a flange supported in said outwardly-open groove of said weapon barrel, in order to facilitate the removal of said gas throughflow element from said bore of said shrunk-fitted ring.

14. A gas removal apparatus for an automatic firing weapon controlled by gas pressure, comprising:

a weapon barrel having a lengthwise axis;

said weapon barrel being provided with a gas removal location;

a weapon housing;

said weapon barrel being detachably secured in said weapon housing;

a gas receiving channel provided in said weapon housing;

said gas removal location provided for said weapon barrel being positioned, as viewed in the direction of the lengthwise axis of the weapon barrel, at a distance upstream of said gas receiving channel in said weapon housing with respect to a predeterminate direction of gas flow between the gas removal location and the gas receiving channel;

groove means provided at said weapon barrel and extending substantially parallel to the lengthwise axis of said weapon barrel between said gas removal location and said gas receiving channel;

a gas rail arranged in said groove means;

means for securing said gas rail in said groove means;

a ring member mounted at said weapon barrel;

said gas rail and said ring member conjointly containing a gas removal channel structure extending from said gas removal location in said weapon barrel to said gas receiving channel in said weapon housing;

a gas throughflow element inserted into said gas removal channel structure;

said gas throughflow element being located in said gas removal channel structure in a transition region between said ring member and said gas rail; and a gas deflection insert positioned in said gas rail between said gas receiving channel and said gas rail.

15. A gas removal apparatus for an automatic firing weapon controlled by gas pressure, comprising:

a weapon barrel having an outer surface and a lengthwise axis;

said weapon barrel being provided with a gas removal location containing a gas removal channel;

a weapon housing;

said weapon barrel being replaceably secured in said weapon housing;

a gas receiving channel provided in said weapon housing;

said gas removal location in said weapon barrel being spaced, as viewed in the direction of the lengthwise axis of the weapon barrel, from said gas receiving channel in said weapon housing;

an outwardly-open groove provided at said outer surface of said weapon barrel and extending in the longitudinal direction of said weapon barrel between said gas removal location and said gas receiving channel;

a gas rail having oppositely situated ends and arranged in said outwardly-open groove;

said gas rail being held at said oppositely situated ends in said outwardly-open groove;

a ring member gas-tightly mounted at said weapon barrel in the region of said gas removal location and connected with one of said oppositely situated ends of said gas rail;

a gas deflection insert inserted into an other one of said oppositely situated ends of said gas rail;

said gas deflection insert containing an eccentrically located bore for flow communication with said gas receiving channel in said weapon housing and bounded by a wall of increased thickness for increased erosion resistance;

said ring member and said gas rail conjointly containing a gas removal channel structure extending from said gas removal channel in said weapon barrel to said gas deflection insert and opening into said gas deflection insert substantially opposite said wall of increased thickness;

said gas removal channel structure obliquely extending from said gas removal channel in said weapon barrel;

a throttling gas throughflow element arranged in a transition region between said ring member and said gas rail; and said throttling gas throughflow element containing a heat resistant insert.

16. The gas removal apparatus as defined in claim 15, wherein:

said gas removal channel obliquely extends from said gas removal location through said weapon barrel.

17. The gas removal apparatus as defined in claim 15, wherein:

said throttling gas throughflow element and said gas deflection insert is slidably arranged in the direction of the gas flow in order to thereby form gas-tight connections with the associated, downstream located portions of the gas rail and the weapon housing, respectively, under the action of the gas flow issuing from the weapon barrel through the gas removal channel.

* * * * *